US007232343B1

(12) United States Patent
Lai

(10) Patent No.: US 7,232,343 B1
(45) Date of Patent: Jun. 19, 2007

(54) TERMINAL-PROTECTIVE CARD CONNECTOR

(75) Inventor: Yaw-Huey Lai, Taipei County (TW)

(73) Assignee: Tai-Sol Electronics Co., Ltd., Taipei (TW)

( * ) Notice: Subject to any disclaimer, the term of this patent is extended or adjusted under 35 U.S.C. 154(b) by 0 days.

(21) Appl. No.: 11/656,407

(22) Filed: Jan. 23, 2007

(30) Foreign Application Priority Data

Jul. 6, 2006 (TW) ..... 95211891 U

(51) Int. Cl.
*H01R 24/00* (2006.01)

(52) U.S. Cl. ..... 439/630

(58) Field of Classification Search ..... 439/630, 439/159, 260, 267, 160
See application file for complete search history.

(56) References Cited

U.S. PATENT DOCUMENTS 6,699,053 B2 * 3/2004 Kuroda ..... 439/218
7,052,325 B2 * 5/2006 Lin et al. ..... 439/630
7,056,154 B2 * 6/2006 Washino ..... 439/630

FOREIGN PATENT DOCUMENTS

TW M277143 10/2005

* cited by examiner

*Primary Examiner*—Phuong Dinh
(74) *Attorney, Agent, or Firm*—Bacon & Thomas, PLLC

(57) ABSTRACT

A terminal-protective card connector is composed of a housing, at least two groups (first and second) of terminals, and a pressing member. All of the terminals are mounted in the housing. The second group of terminals is located in front of the first group of terminals. Each of the terminals in the second group is elastically raised, having a contact portion formed at a distal end thereof. The housing further includes a rectangular receiving portion and two stopping portions formed at least one pair of opposite lateral edges of the receiving portions. The pressing member has two stopped portion corresponding to the two stopping portions, and a plurality of through formed therethrough. The terminals in the second group are raised against the pressing member and the contact portions extend through the through holes to be exposed above the pressing member.

5 Claims, 13 Drawing Sheets

TERMINAL-PROTECTIVE CARD CONNECTOR

BACKGROUND OF THE INVENTION

1. Field of the Invention

The present invention relates generally to electronic apparatuses, and more particularly, to a terminal-protective card connector.

2. Description of the Related Art

A conventional terminal-protective card connector as disclosed in my prior invention granted as Taiwan Patent Publication No. M277143 provides protection for the terminals mounted therein, having a housing, a pressing member having a bevel formed at a front end thereof, two guide portions located at two sides of the pressing member, and two guide rails located at two sidewalls of the housing. While different cards are inserted into the card connector, they work on the bevel to press the pressing member and then the pressing member lowers inside the housing via the two guide portions; meanwhile, the terminals are forced to move downward to prevent the card from crashing into and damaging the terminals. Accordingly, the terminals are protected in the conventional card connector.

However, there is still some space for improvement of the aforementioned card connector because it can be simpler in structure and smoother in operation.

SUMMARY OF THE INVENTION

The primary objective of the present invention is to provide a terminal-protective card connector which enables terminals thereof to be electrically connected with a corresponding card and protects the terminals from crash of other cards and from deformation or damage incurred by the crash.

The secondary objective of the present invention is to provide a terminal-protective card connector which simpler in structure and smoother in operation than the prior art.

The foregoing objectives of the present invention are attained by the terminal-protective card connector composed of a housing, at least two groups of terminals, and a pressing member. The housing includes an opening formed at a front end thereof. All of the terminals are mounted to the housing, extending into the housing. The at least two groups of terminals are defined as a first group of terminals and a second group of terminals respectively. The first group of terminals is located at a rear end inside the housing. The second group of terminals is located at a bottom side inside the housing and in front of the first group of terminals. Each of the terminals in the second group is elastically raised, having a contact portion formed at a distal end thereof. The housing further includes a rectangular receiving portion formed below the contact portions of the second group of terminals, and two stopping portions formed at respective bottom sides of at least one pair of opposite lateral edges of the receiving portions. The pressing member has a stopped portion formed at least one pair of opposite lateral edges thereof and corresponding to the two stopping portions, and a plurality of through formed therethrough. The terminals in the second group are raised against a bottom side of the pressing member and the contact portions extend through bottom sides and then top sides of the through holes to be exposed above the pressing member. Accordingly, the present invention can protect the terminals and be structurally simpler than the prior art.

DETAILED DESCRIPTION OF PREFERRED EMBODIMENTS

Figure 1:
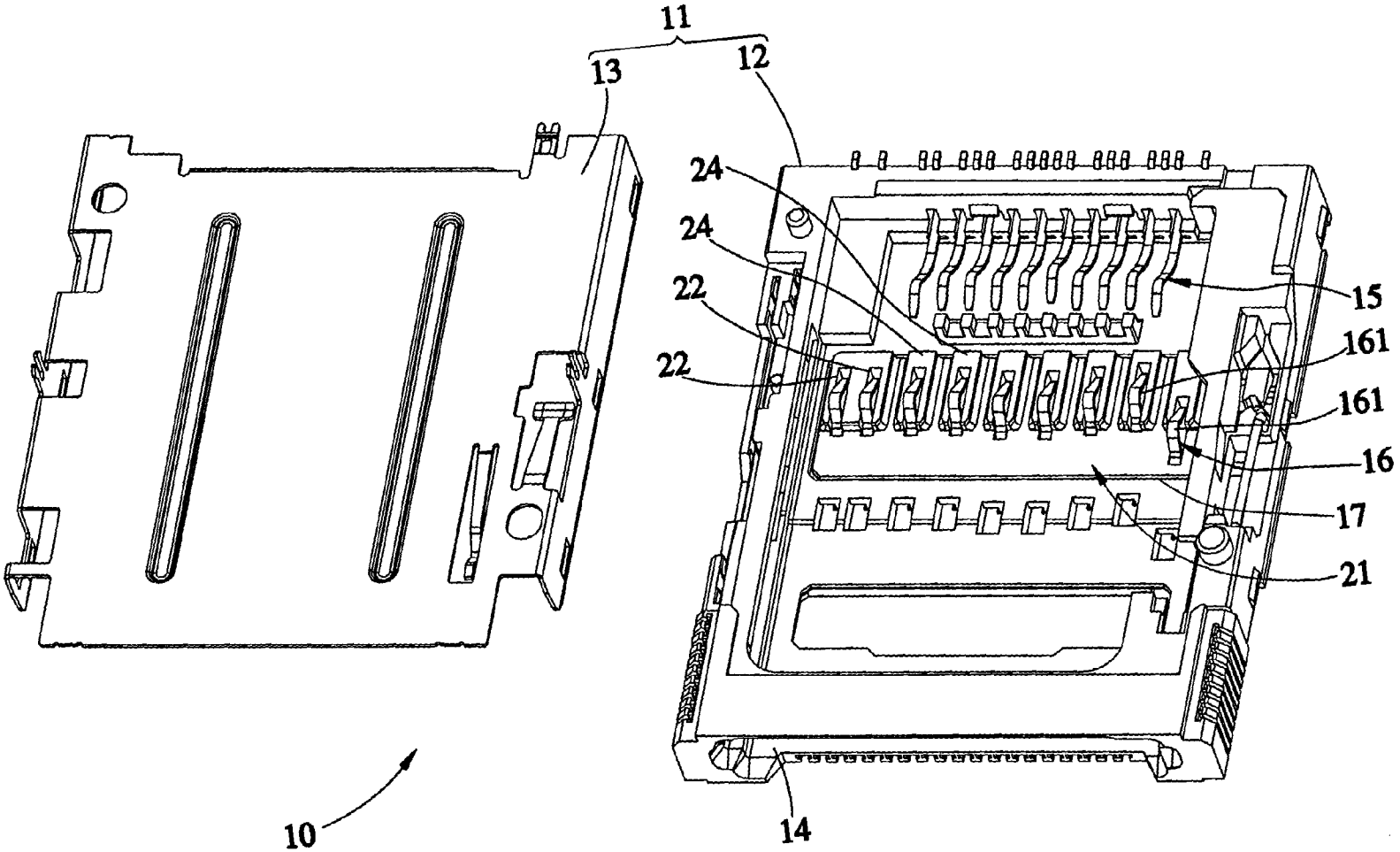
FIG. 1 is a perspective view of a first preferred embodiment of the present invention which cover member is separated therefrom.
Figure 2:
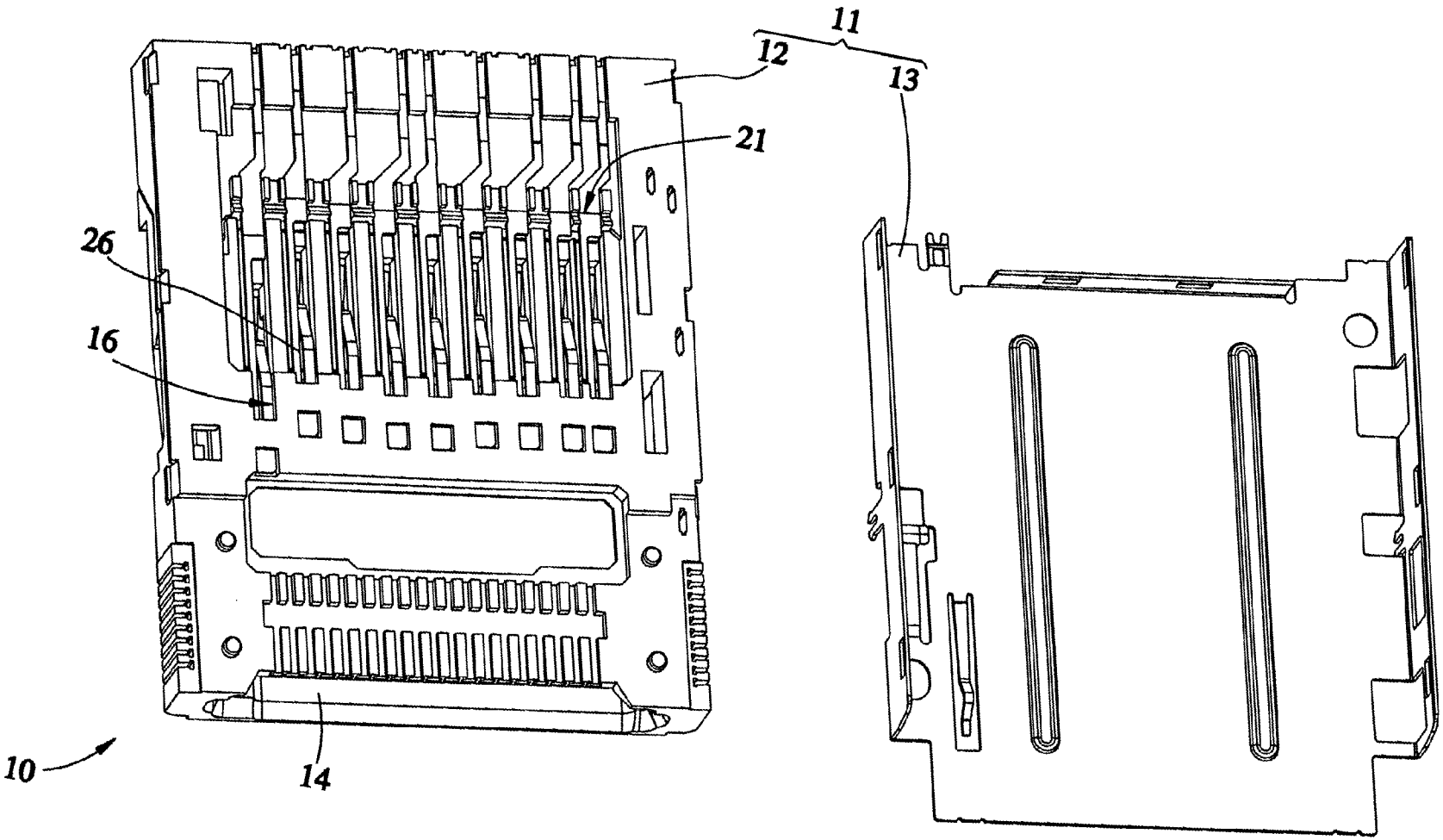
FIG. 2 is another perspective view of the first preferred embodiment of the present invention which cover member is separated therefrom.
Figure 3:
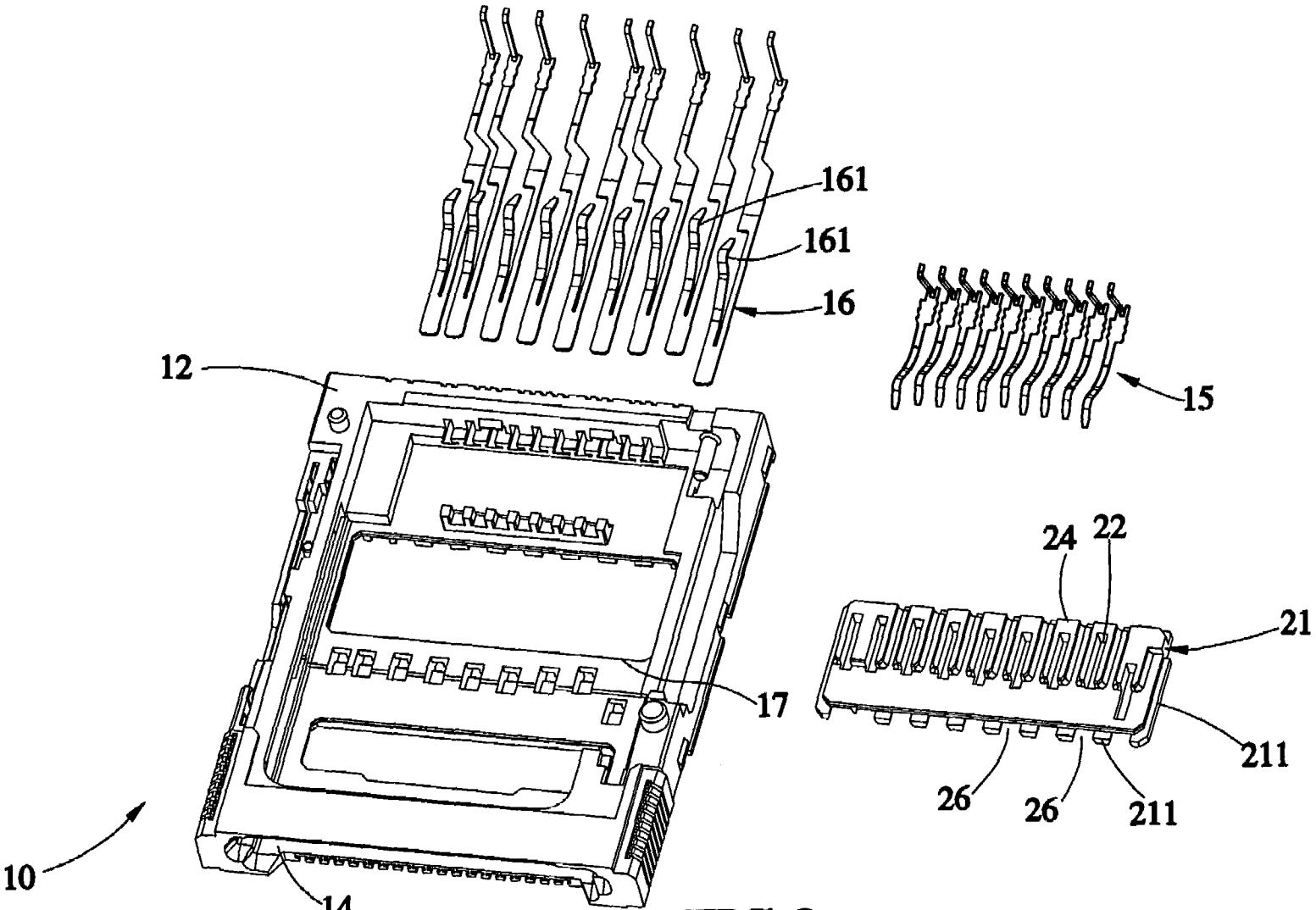
FIG. 3 is an exploded view of the base frame of the first preferred embodiment of the present invention.
Figure 4:
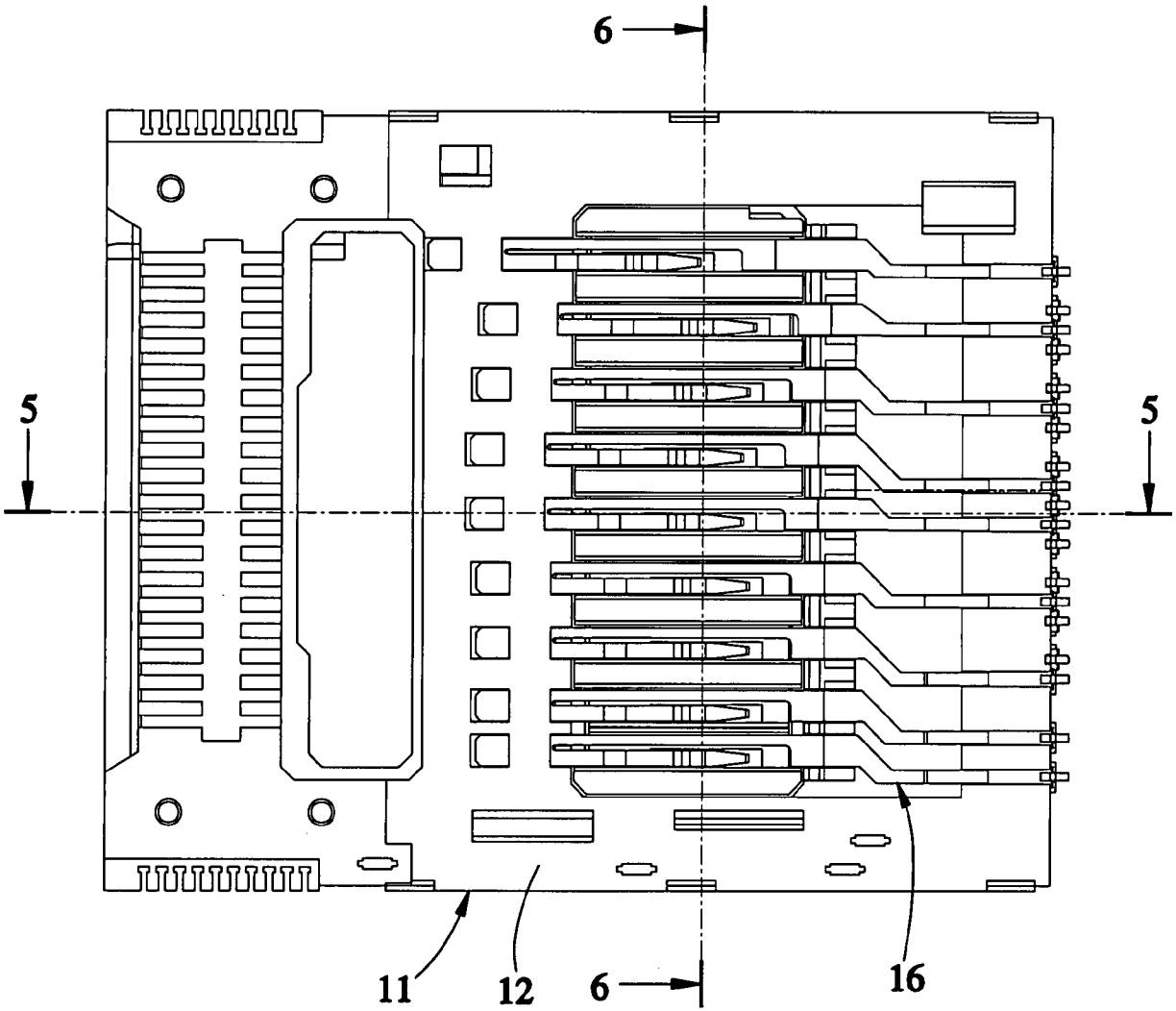
FIG. 4 is a bottom view of the first preferred embodiment of the present invention.

Referring to FIGS. 1-6, a terminal-protective card connector 10 constructed according to a first preferred embodiment of the present invention is composed of a housing 11 and a pressing member 21.

The housing 11 includes a base frame 12, a cover member 13, and an opening 14 formed at a front end thereof for receiving a memory card. Two groups of terminals defined as a first group 15 and a second group 16 respectively are mounted to the base frame 12, extending into between the base frame 12 and the cover member 13. The first group of the terminals 15 is located at a rear end of the base frame 12, for compatibly electric connection with a memory stick (MS) memory card. The second group of terminals 16 is located at a top side of the base frame 12 and relatively in lower space between the base frame 12 and the cover member 13, in front of the first group of terminals 15 for compatibly electric connection with a secure digital (SD) memory card. Each of the terminals in the second group 16 has a body portion elastically raised, and a contact portion 161 formed at a distal end of the body portion. The base frame 12 has a rectangular receiving portion 17 recessed thereon and located below the contact portions 161, and four stopping portions 171 formed at respective bottom sides of four lateral edges thereof around the receiving portion 17.

The pressing member 21 is rectangular and vertically movably mounted in the receiving portion 17. The pressing member 21 includes four stopped portions 211, a plurality of through holes 22, a plurality of U-shaped convexities 24, and a plurality of channels 26. The stopped portions 211 are formed at four lateral edges of the pressing member 21, corresponding to the respective stopping portions 171. The through holes 22 extend through the pressing member 21. The body portions of the terminals in the second group 16 are raised against a bottom side of the pressing member and the contact portions of the same extend through bottom sides and then top sides of the through holes 22 to be exposed above the pressing member 21. Each of the U-shaped convexities 24 is formed partially around the through hole 22 to partially surround the contact portion 161. The channels 26 are formed at the bottom side of the pressing member 21 for accommodating the body portions of the terminals in the second group 16.

Figure 5:
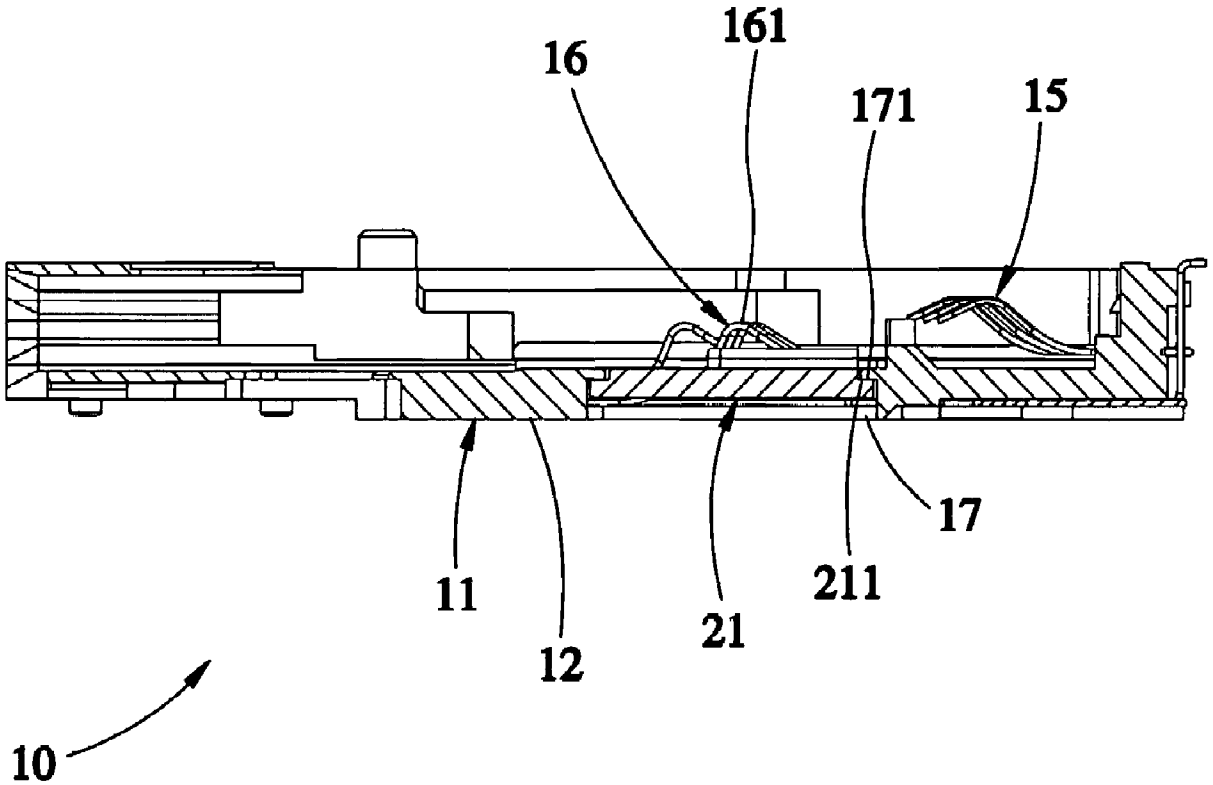
FIG. 5 is a sectional view taken along a line 5-5 indicated in FIG. 4.
Figure 6:
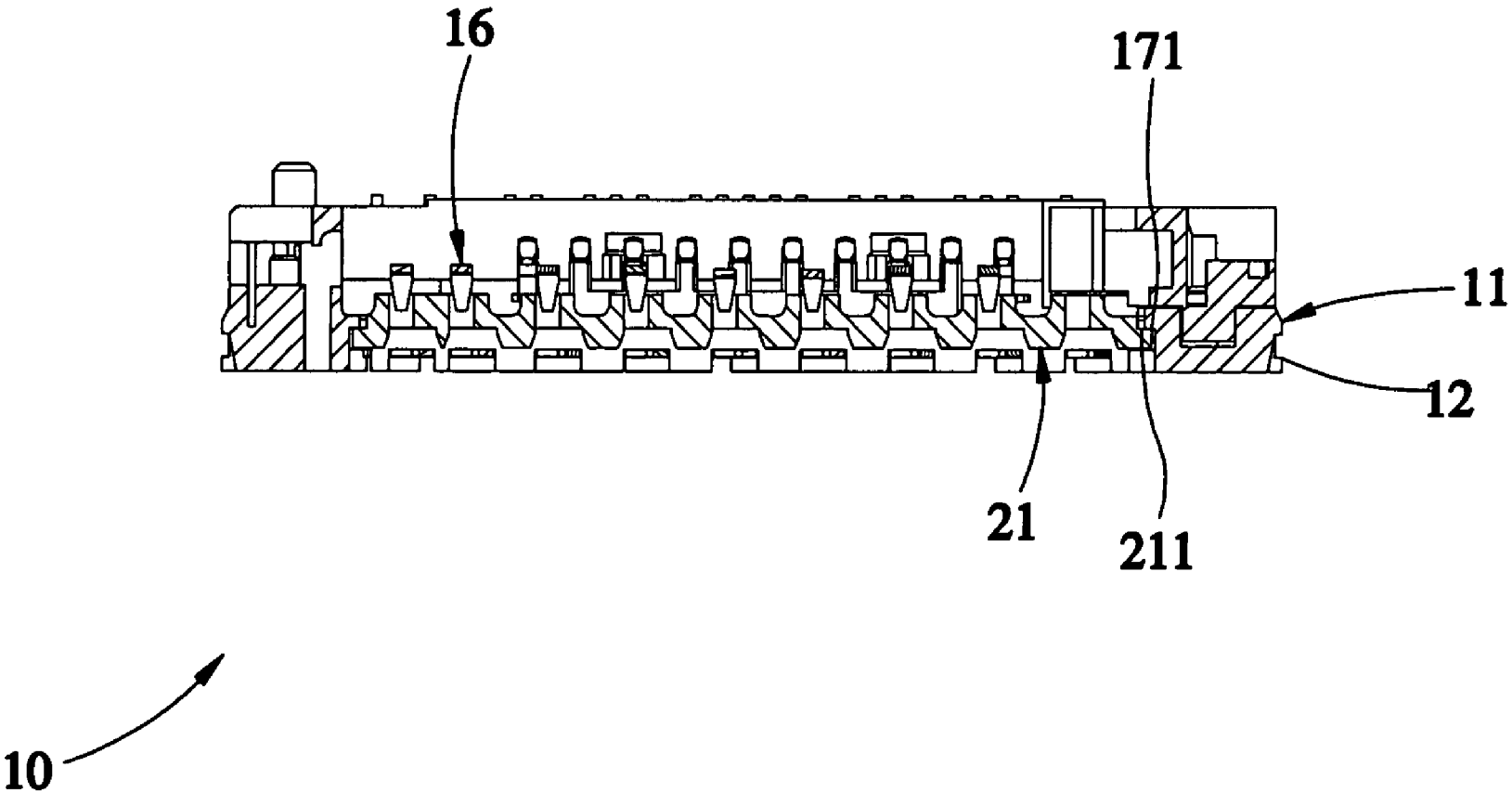
FIG. 6 is a sectional view taken along a line 6-6 indicated in FIG. 4.

Referring to FIG. 5, while none of any card is inserted into the card connector 10, the pressing member 21 is raised and supported by the raised second group of terminals 16 and stopped by the stopping portions 171 through the stopped portions 211 thereof, wherein the stopping portions 171 are acted as a stop point that the pressing member 21 stops being raised.

Figure 7:
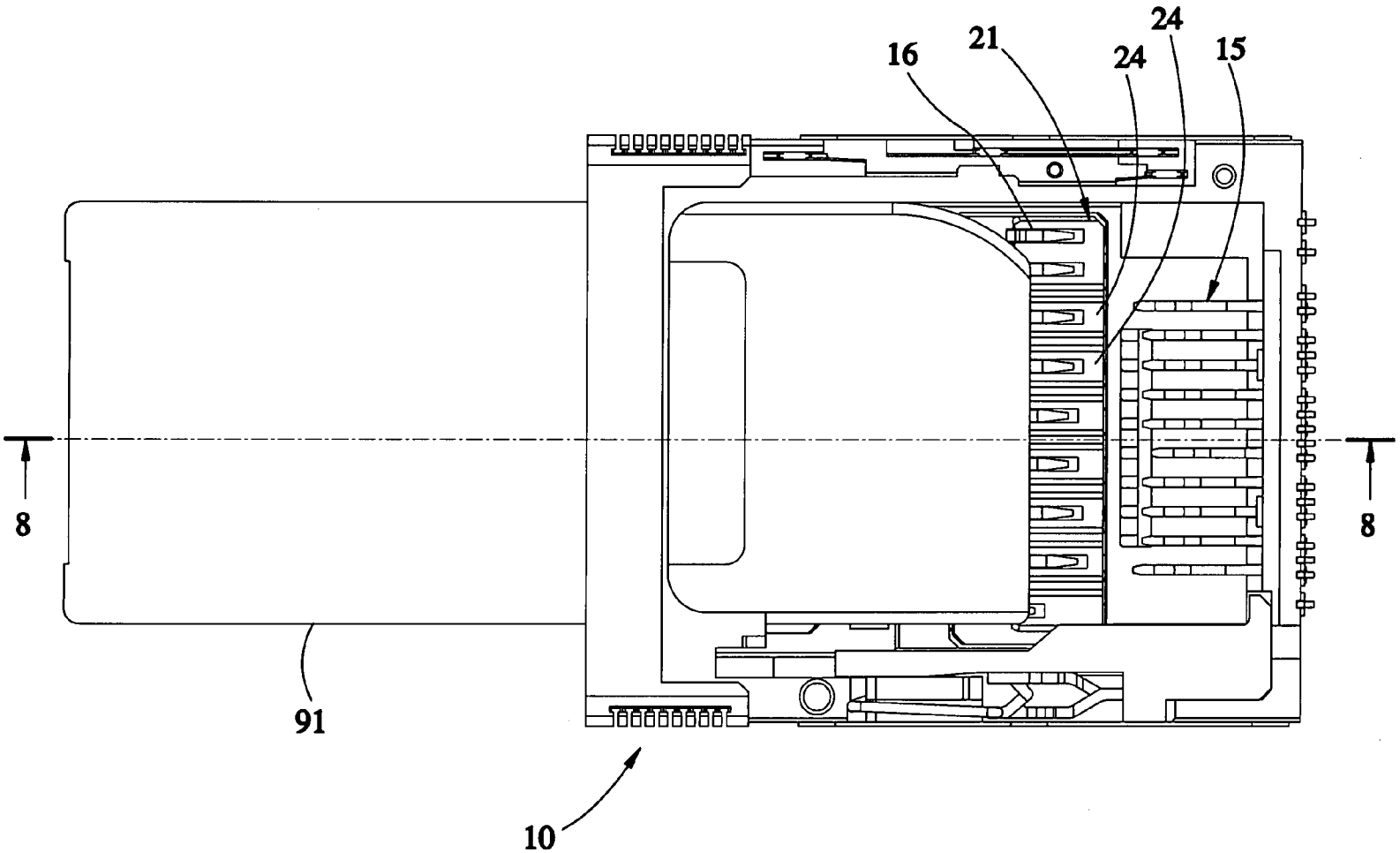
FIG. 7 is a top view of the first preferred embodiment of the present invention, illustrating a memory card is initially inserted therein.
Figure 8:
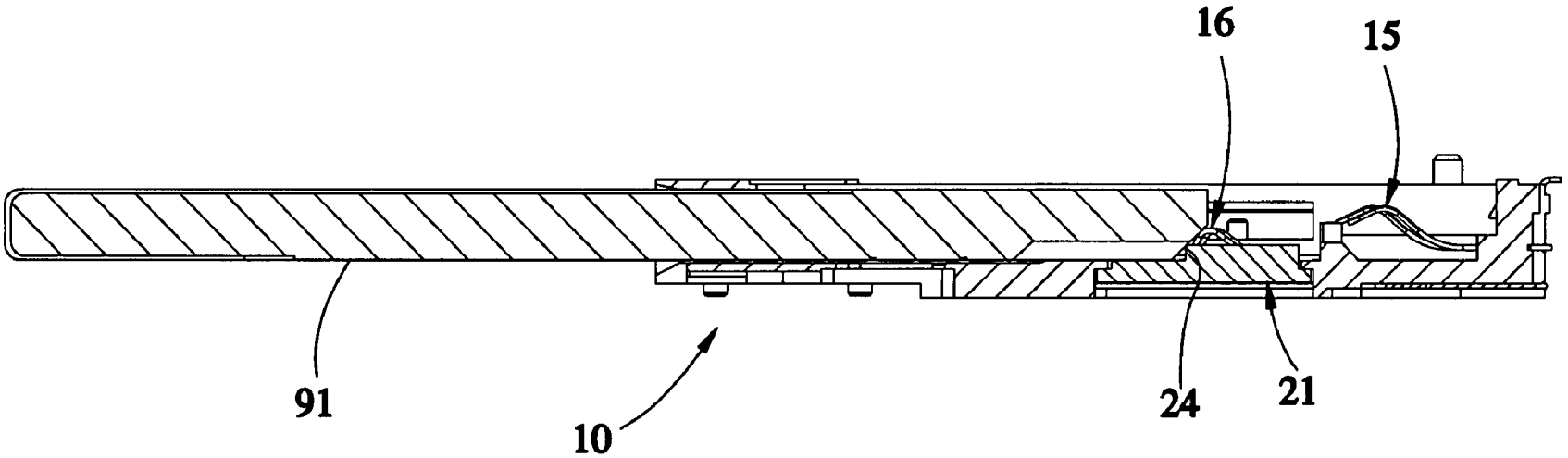
FIG. 8 is a sectional view taken along a line 8-8 indicated in FIG. 7.
Figure 9:
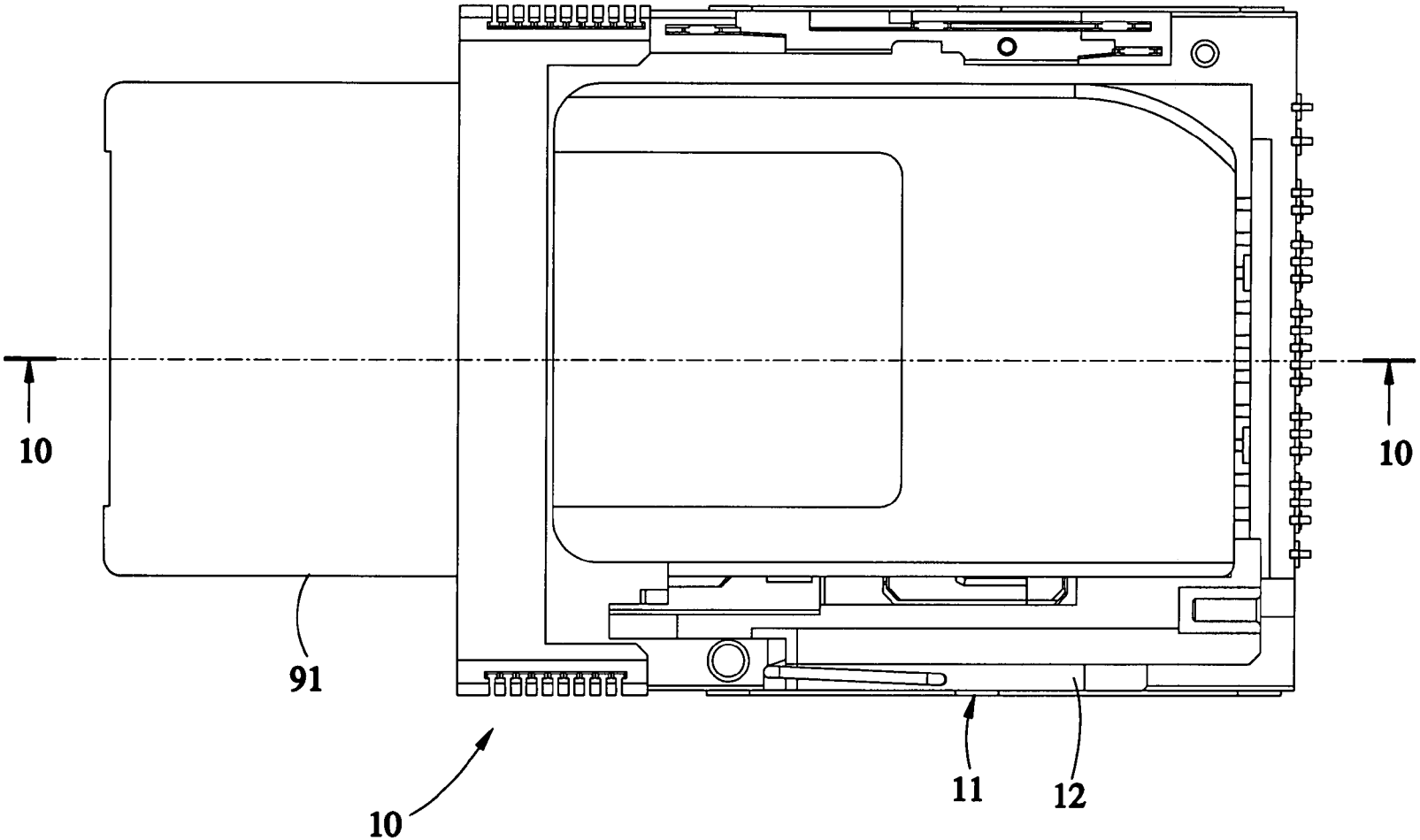
FIG. 9 is another top view of the first preferred embodiment of the present invention, illustrating the memory card is fully inserted therein.
Figure 10:
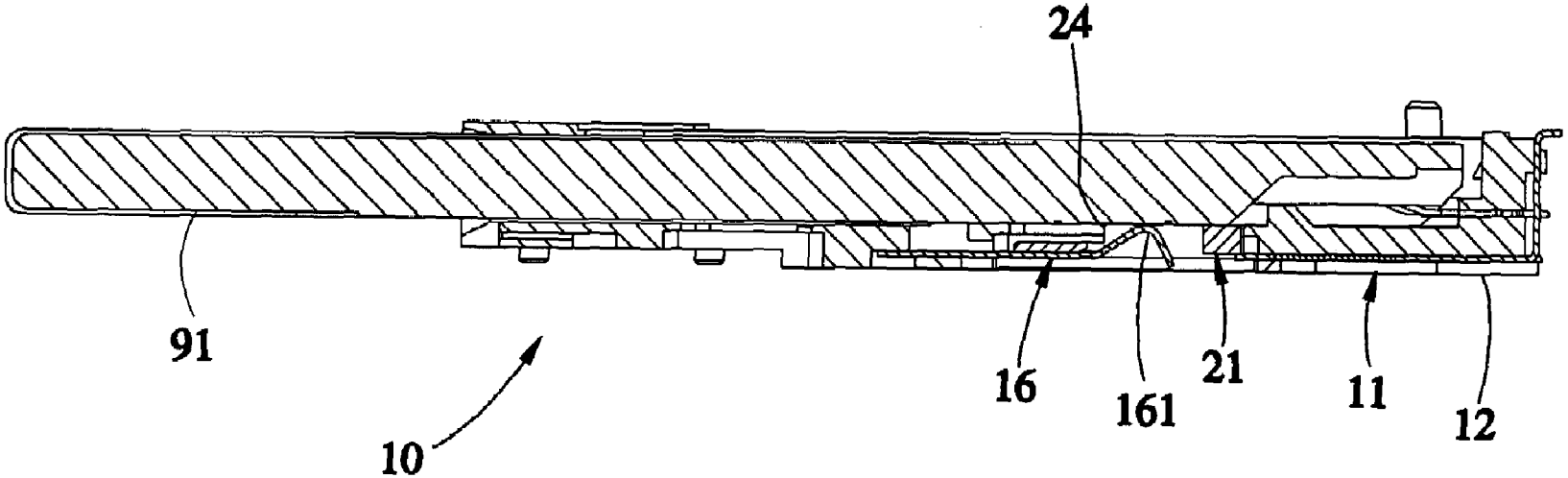
FIG. 10 is a sectional view taken from a line 10-10 indicated in FIG. 9.

Referring to FIGS. 7 and 8, while an MS card 91 is being inserted into the card connector 10, a lower edge of a front end of the MS card 91 contacts against front edges of the U-shaped convexities 24. As shown in FIGS. 9 and 10, while the MS card 91 continues to move to the innermost end in the card connector 10, it presses the pressing member 21 to further drive the second group of terminals 16 to move downward and to sink in the U-shaped convexities 24, further preventing the MS card 91 from crashing into the terminals 16 for protection of the terminals 16. During the extraction of the MS card 91 from the card connector 10, after the front end of the MS card 91 disengages from the pressing member 21, the pressing member 21 is raised by the terminals 16 and then the contact portions 161 are exposed outside the U-shaped convexities 24.

Figure 11:
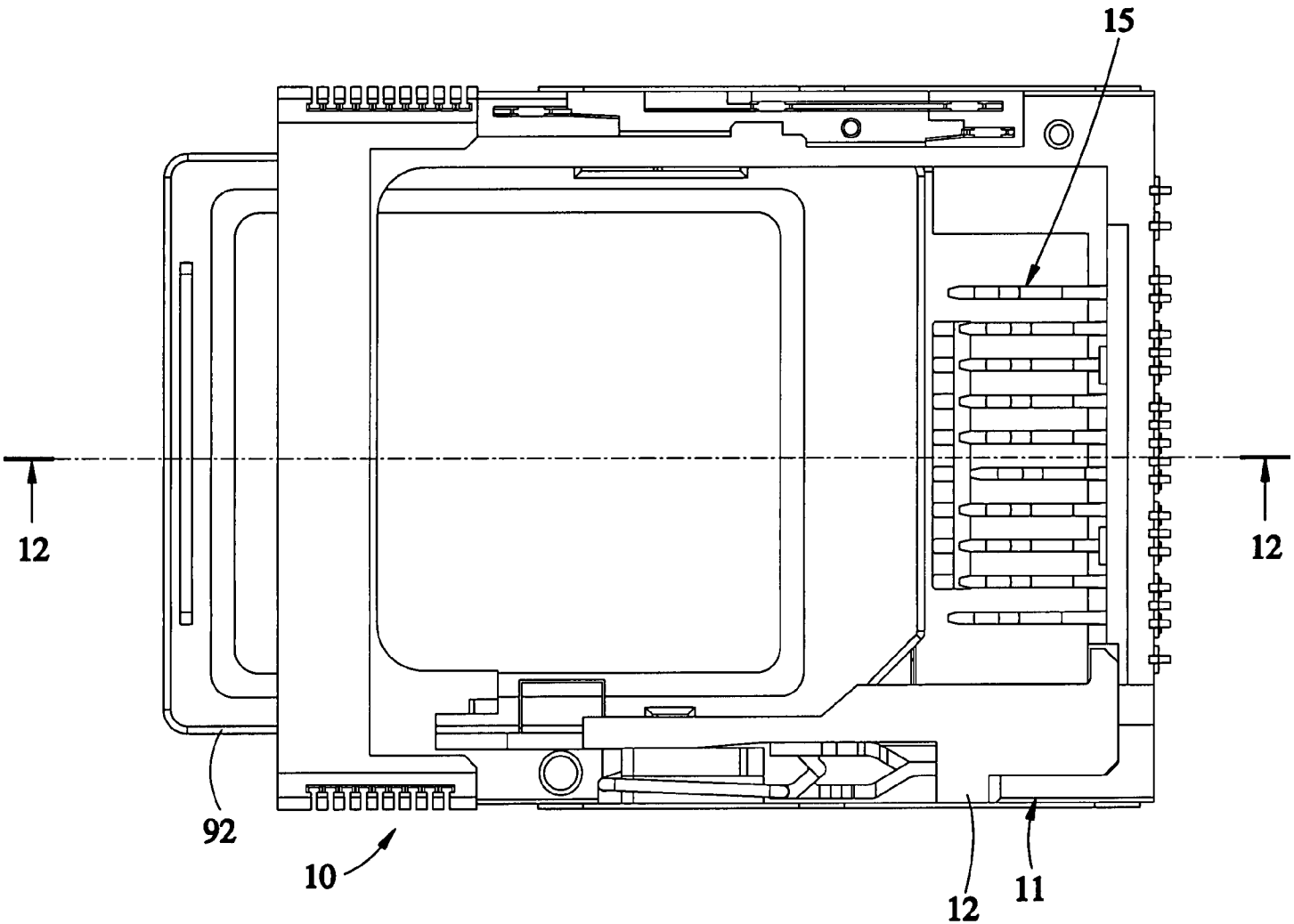
FIG. 11 is another top view of the first preferred embodiment of the present invention, illustrating another memory card is fully inserted therein.
Figure 12:
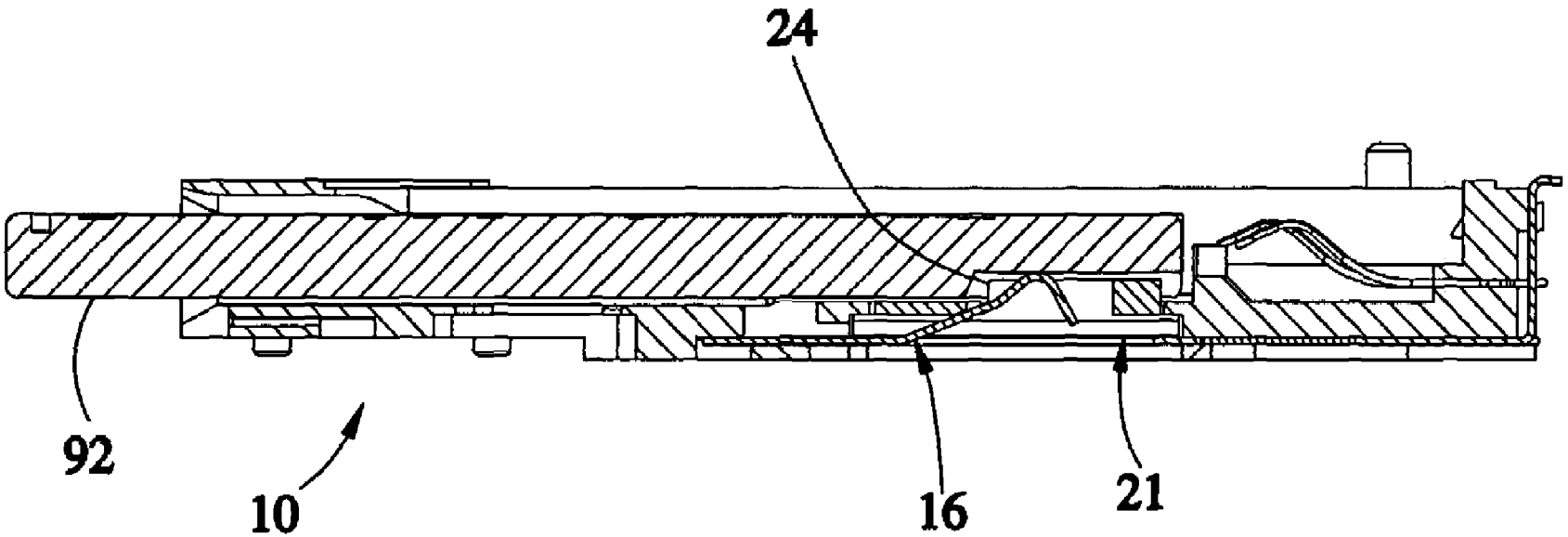
FIG. 12 is a sectional view taken along a line 12-12 indicated in FIG. 11.

Referring to FIGS. 11 and 12, while an SD card 92 is being inserted into the card connector 10, during the insertion, it neither works on the pressing member 21 nor the U-shaped convexities 24 but directly on the terminals 16.

Figure 13:
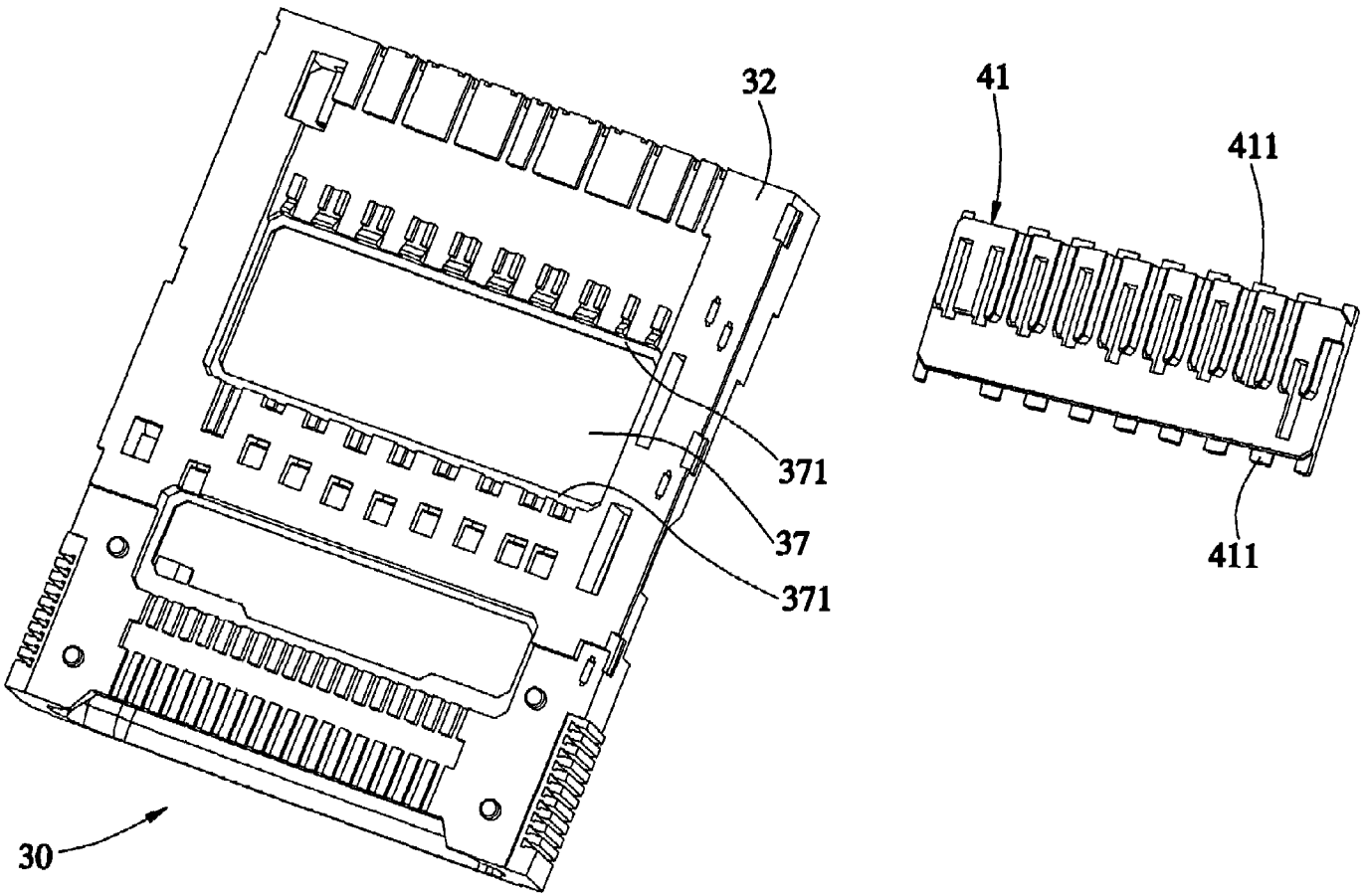
FIG. 13 is an exploded view of the base frame of a second preferred embodiment of the present invention.

Referring to FIG. 13, a terminal-protective card connector 30 constructed according to a second preferred embodiment of the present invention is similar to that of the first embodiment but different as recited below.

The base frame 32 includes two stopping portions 371 formed at respective bottom sides of two opposite lateral (front and rear) edges of the receiving portion 37. The pressing member 41 includes two stopped portions 411 formed at respective opposite lateral (front and rear) edges thereof. In FIG. 13, the base frame 32 is viewed from the bottom side thereof. The pressing member 41 is viewed from the top side thereof. The pressing member 41 is raised and supported by the second group of terminals (not shown) and stopped by the stopping portions 371 through the stopped portions 411 thereof, wherein the stopping portions 371 are acted as a stop point that pressing member 41 stops being raised. The way that the stopping and stopped portions 371 and 411 contact against each other in the second embodiment is the same as that of the first embodiment.

It is to be noted that the stopping and stopped portions can be alternatively located at the left and right sides of the base frame and the pressing member respectively.

In conclusion, the present invention includes the following advantages.

1. Protection of Terminals

The present invention can press the terminals, i.e. second group, compatible with the SD card 92, during the insertion of the MS card, to prevent the terminals from crash of the MS card and to further protect the terminals from deformation or damage resulted from the crash, securing the reliability of the card connector in operation.

2. Simple Structure

The present invention is structurally simpler than the prior art because it is not necessary to provide a bevel and mount guide portions/rails at two sides of the pressing member and/or the housing in the present invention, merely employing the stopping and stopped portions for the stopping effect.

Although the present invention has been described with respect to specific preferred embodiments thereof, it is no way limited to the details of the illustrated structures but changes and modifications may be made within the scope of the appended claims.

What is claimed is:

1. A terminal-protective card connector comprising:

a housing having an opening formed at a front end thereof, at least two groups of terminals being mounted to said housing and extending into said housing and defined as a first group of terminals and a second group of terminals respectively, said first group of terminals being located at a rear end in said housing, said second group of terminals being located at a bottom side in said housing and in front of said first group of terminals, each of said terminals in the second group being elastically raised and having a contact portion formed at a distal end thereof, said housing having a rectangular receiving portion recessed thereon and located below said contact portions, and two stopping portions formed at respective bottom sides of at least one pair of opposite lateral edges of said receiving portion; and a rectangular pressing member vertically movably mounted in said receiving portion, said pressing member having two stopped portions formed at least one pair of opposite lateral edges thereof and corresponding to said stopping portions of said housing, and a plurality of through holes formed therethrough;

wherein said terminals in the second group are raised against a bottom side of said pressing member, and said contact portions extend through bottom sides and then top sides of said through holes to be exposed above said pressing member.

2. The card connector as defined in claim 1, wherein said housing comprises four stopping portions formed at respective bottom sides of four lateral edges of said receiving portion; said pressing member comprises four stopped portions formed at respective four lateral edges thereof.

3. The card connector as defined in claim 1, wherein said pressing member further comprises a plurality of U-shaped convexities formed partially around said through holes respectively and partially surrounding said contact potions respectively.

4. The card connector as defined in claim 1, wherein said housing is composed of a base frame and a cover member.

5. The card connector as defined in claim 1, wherein said pressing member further comprises a plurality of channels formed at the bottom side thereof; said terminals in the second group are received in said channels respectively.

* * * * *